US006237664B1

(12) United States Patent
Becker

(10) Patent No.: US 6,237,664 B1
(45) Date of Patent: May 29, 2001

(54) LABELING APPARATUS

(75) Inventor: Werner Becker, Hirschhorn (DE)

(73) Assignee: Meto International GmbH, Hirschhorn (DE)

( * ) Notice: Subject to any disclaimer, the term of this patent is extended or adjusted under 35 U.S.C. 154(b) by 0 days.

(21) Appl. No.: 09/317,937

(22) Filed: May 25, 1999

(30) Foreign Application Priority Data

Jul. 24, 1998 (DE) ..... 198 33 408

(51) Int. Cl.[7] ..... B65C 11/02

(52) U.S. Cl. ..... 156/538; 156/387; 156/541; 156/579; 492/30; 492/31; 492/33; 492/35; 492/36

(58) Field of Search ..... 156/387, 541, 156/579, 538; 492/30, 31, 33, 35, 36

(56) References Cited

U.S. PATENT DOCUMENTS

| | | | | |
|---|---|---|---|---|
| 3,715,262 | * | 2/1973 | Kelly | 156/541 |
| 4,267,006 | | 5/1981 | Karn et al. | 156/384 |
| 4,737,223 | * | 4/1988 | Koch | 156/475 |
| 4,787,955 | * | 11/1988 | Nagel et al. | 156/488 |

FOREIGN PATENT DOCUMENTS

| | | |
|---|---|---|
| 1 155 390 | 7/1971 | (DE) . |
| 3207053A1 | 9/1983 | (DE) . |
| 3515594C1 | 10/1986 | (DE) . |
| 3515610C1 | 10/1986 | (DE) . |
| 4139808C1 | 2/1993 | (DE) . |

* cited by examiner

*Primary Examiner*—Linda Gray
(74) *Attorney, Agent, or Firm*—Jones, Tullar & Cooper, P.C.

(57) ABSTRACT

The present invention relates to a labeling apparatus for paying out and applying self-adhesive labels, which with each operating cycle moves one self-adhesive label into a dispensing position underneath an applicator roll having a sleeve with a cylindrical jacket, via which sleeve the applicator roll is rotatably mounted on a hub. It is proposed to equip the sleeve with at least one profiled ring projecting radially outwardly beyond the cylindrical jacket. Because the profiled ring and the sleeve are made preferably of a material that is harder than the cylindrical jacket and hence ink-repellent, the printed data on the label are not smeared, in spite of the low outlay involved in the manufacture of the applicator roll.

11 Claims, 1 Drawing Sheet

LABELING APPARATUS

FIELD OF THE INVENTION

This invention relates to a labeling apparatus for paying out and applying self-adhesive labels. The labeling apparatus has an applicator roll having a sleeve with a cylindrical jacket via which sleeve the applicator roll is rotatably mounted on a hub. With each operating cycle of the labeling apparatus one self-adhesive label is moved into a dispensing position underneath the applicator roll.

BACKGROUND OF THE INVENTION

A labeling apparatus of this type is known from German patent DE 30 30 153 A. It possesses an applicator roll having a cylinder with a profiled envelope surface and a sleeve via which the applicator roll is rotatably mounted on a rigid hub. A relatively soft plastic is used as the material for the cylinder in order to guarantee a certain adaptation of the applicator roll to the surface of the object needing to be marked.

The label is printed with data directly before it is applied. The ink used for the printing does not dry by evaporation but by penetrating the label material. On account of the fast sequence of operations when labeling articles it can happen that the profiled envelope surface comes into contact with printed data which are not yet dry. The soft plastic material tends to pick up ink but without absorbing it. Consequently, when that part of the envelope surface wetted with ink next comes into contact with a label or the surface of an article needing to be marked, it leaves the ink there. The results are rather unattractive streaks on the printed labels.

The use of relatively hard plastic material to manufacture the cylinders is known from German patent DE 32 07 053 A. This material being severely ink-repelling, it largely prevents the above described streaking. To enable the applicator roll to display the requisite flexibility it is carried in a central area of its longitudinal dimension on an elastically deformable hub. Similar applicator rolls are disclosed in German patent DE 35 15 594 A and German patent DE 35 15 610 A, where profiled rolls are spring-mounted singly and jointly, respectively. A disadvantage in these arrangements is considered to be the high outlay needed to produce the bearing structure.

U.S. Pat. No. 4,267,006 discloses a labeling apparatus in which the applicator roll is comprised of small individual wheels made of a rubber-like material and having a corrugated outer circumference and the form of a truncated cone. By turning the wheels they can be positioned on their bearing axle so that, as a result of their conical shape, there is no fear of any contact with the printed data and hence no fear of smearing. This again requires a relatively high production outlay.

SUMMARY OF THE INVENTION

It is an object of the present invention to further develop a prior-art labeling apparatus so as to eliminate the risk of smearing of the printed data in spite of the low level of outlay.

According to the present invention this object is accomplished with a prior-art labeling apparatus by having the sleeve equipped with at least one profiled ring projecting radially outwardly beyond the cylindrical jacket.

One proposal involves equipping the sleeve mounted on the hub with a profiled ring that projects radially outwardly to perform the pressing-on function. Since the profiled ring and the sleeve are made preferably of a material which is harder than the cylindrical jacket, and therefore—as in German patent DE 32 07 053—likewise ink-repelling, the printed data on the label are not smeared by the profiled ring.

Hence the advantage of the present invention is that there is no fear of smearing the label in spite of the low outlay involved in the manufacture of the applicator roll.

The cylindrical jacket can equally be equipped with profiled rings projecting radially outwardly, which conveniently are fitted to points that have no contact as a rule with the printed parts of the label, meaning that they are positioned (in the longitudinal direction of the sleeve) at the outer ends of the cylindrical jacket, for example.

The profiled ring of the sleeve is arranged preferably in a roughly central position in the longitudinal direction of the sleeve, thus resulting in a symmetrical arrangement of the projecting profiled rings (of the sleeve and the cylindrical jacket) and hence in an optimum pressing of the label onto the article needing to be marked. Even when the labeling apparatus is slightly tilted to the side, the dispensed label can still be applied correctly to the article thanks to the elasticity of the cylindrical jacket's profiled ring.

As an alternative to positioning the profiled ring of the sleeve centrally on the sleeve, it can be shifted sideways away from the center of the sleeve. The reason for this arrangement is to position the profiled ring of the sleeve advantageously at a point (in the axial direction of the sleeve) where the printing mechanism does not print any data on the label, because then no printed data will be smeared. With a printing mechanism having an even number of digits (e.g., six or eight), such a position is at the exact center of the sleeve, meaning that a profiled ring set in exactly the central position is advantageous. With a printing mechanism having an odd number of digits such as seven digits, it makes sense to shift the profiled ring somewhat out of center in the axial direction of the sleeve so that its position coincides with a space between two printing bands. The labeling apparatuses can then be supplied with applicator rolls specially adapted to the particular printing mechanism, or the applicator rolls can be interchangeable.

To simplify production it is preferred to have the profiled ring integrally formed with the sleeve.

Possible materials for the sleeve and the profiled ring are in particular relatively hard plastics such as Teflon, whereas the preferred choice for the cylindrical jacket is a relatively soft material, particularly rubber or plastic.

Further details, advantages and features of the present invention will be explained in more detail in the following with reference to the accompanying drawings.

DESCRIPTION OF THE PREFERRED EMBODIMENT

Figure 1:
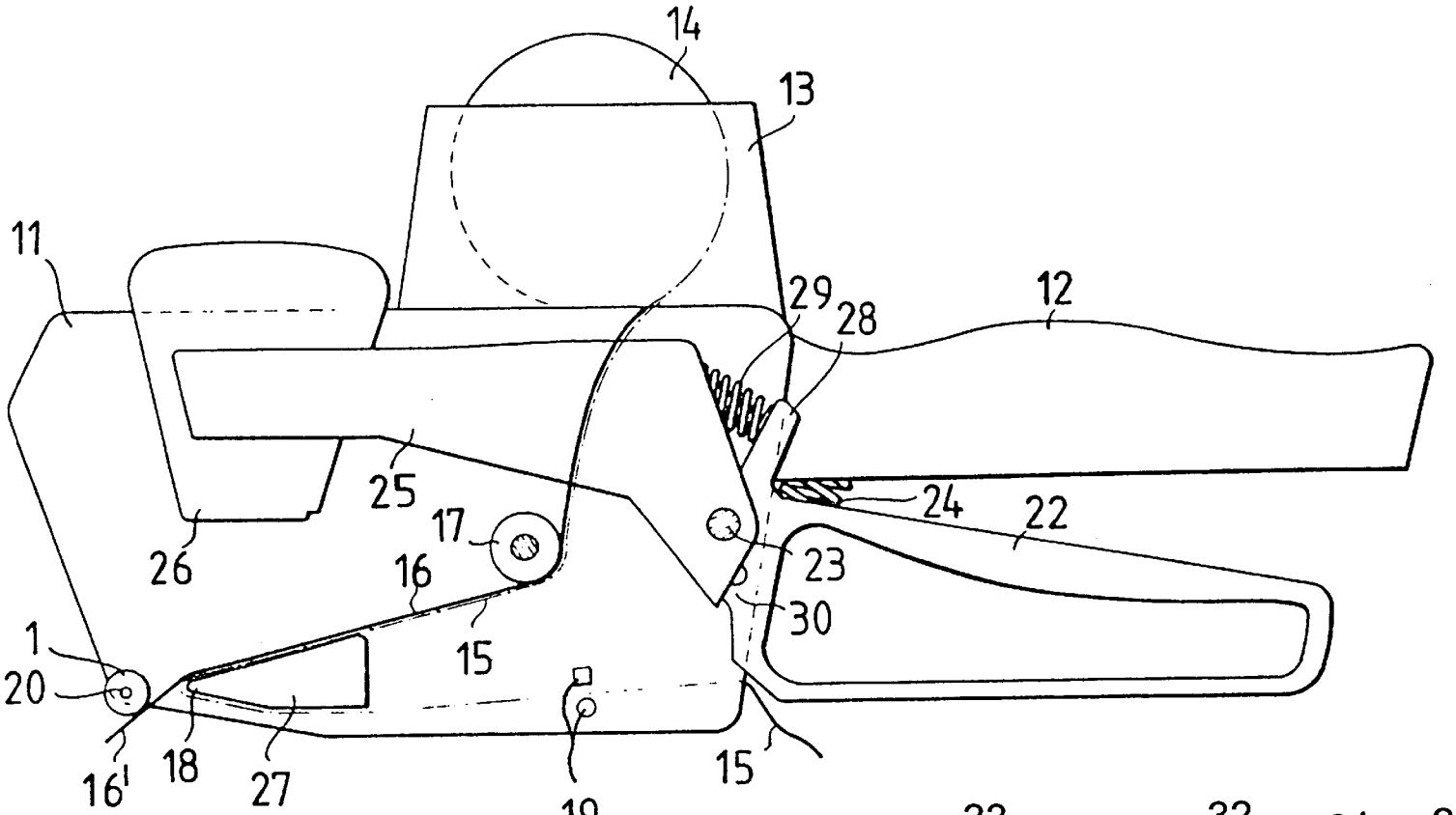
FIG. 1 is a schematic representation of a labeling apparatus.

The labeling apparatus shown in FIG. 1 has a housing 11 to which is fitted a handle 12. On the upper side of the housing is a compartment 13 for accommodating a supply roll 14 of self-adhesive labels 16 adhering to a carrier web 15. The carrier web 15 first passes out of the bottom of the compartment 13 in the apparatus and then, after being deflected by a roller 17, moves forward to a dispensing edge 18 at which the carrier web is deflected and directed past a schematically illustrated feeding mechanism 19 to the rear end of the housing. Rotatably mounted on a hub 20 in front of the dispensing edge 18 inside the housing 11 is an applicator roll 1 enabling a label 16', when in the dispensing position after being delaminated from the carrier web 15 at the dispensing edge 18, to be pressed onto an article, the applicator roll 1 using a rolling action for this purpose.

Rotatably mounted on a hub 23 underneath the handle 12 is an actuating lever 22. Seated between the handle 12 and the actuating lever 22 is a spring 24 which always tries to urge the actuating lever 22 into the position of rest shown in FIG. 1. Received in the interior of the housing 11 is also a printing mechanism lever 25 which is likewise rotatably mounted on the hub 23. This printing mechanism lever 25 carries a printing mechanism 26 for printing data on a self-adhesive label 16 resting on a platen 27. Seated between an arm 28 of the actuating lever 22 and the printing mechanism lever 25 is a further spring 29 which serves the function of transferring a movement of the actuating lever 22 directed at the handle onto the printing mechanism lever 25. In the position of rest illustrated in FIG. 1, the printing mechanism lever 25 is held in the elevated position by a lug 30 formed on the actuating lever 22.

For the following brief description of an operating cycle of the apparatus shown in FIG. 1 it is assumed that no self-adhesive label has yet arrived in the dispensing position underneath the applicator roll 1. To initiate an operating cycle the actuating lever 22 is pulled against the handle 12, as a result of which the printing mechanism lever 25 is swiveled around the hub 23 in anticlock-wise direction on account of the action of the arm 28 and the spring 29, causing the printing mechanism 26 to be lowered onto the platen 27. When the printing mechanism 26 impacts on the platen 27, it produces a print on the self-adhesive label 16 lying on the platen 27 at this particular instant. At the same time the feeding mechanism 19 is moved by a lever connection, not shown, from the position shown in FIG. 1 toward the platen 27 along the carrier web 15. When the actuating lever 22 is released, the spring 24 returns the actuating lever to the initial position shown in FIG. 1, whereby the lug 30 swivels the printing mechanism lever 25 around the hub 23 back to its illustrated initial position. At the same time the feeding mechanism 19 is also moved back to its initial position shown in FIG. 1; during this movement, however, it is firmly engaged with the carrier web 15, causing the web to be pulled around the dispensing edge 18 by a distance equivalent to the length of one self-adhesive label. As this occurs, a self-adhesive label detaches from the carrier web 15 at the dispensing edge 18 and adopts the position of the self-adhesive label 16' underneath the applicator roll 1. The self-adhesive label 16' can now be adhered to an article by means of a rolling action of the applicator roll 1.

Figure 2:
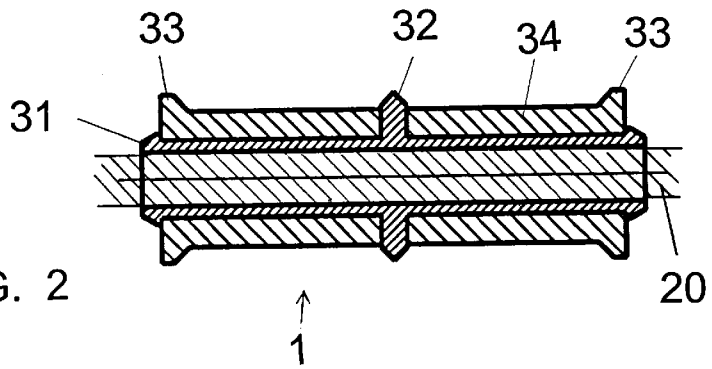
FIG. 2 is a sectional view of the applicator roll used in the apparatus of FIG. 1.

FIG. 2 shows a cross section of an applicator roll 1 as it is suitable for use in the apparatus illustrated FIG. 1. In its basic configuration the applicator roll 1 is comprised of a sleeve 31 rotatably mounted on the hub 20, which is rigidly secured to the housing 11. The sleeve 31 has a radially outwardly projecting profiled ring 32 positioned centrally in the sleeve's longitudinal direction and integrally formed with the sleeve 31. A (two-piece) cylindrical jacket 34 is fitted to the sleeve 31 on either side of the profiled ring 32. The cylindrical jacket is equipped likewise at each of its outer ends with a profiled ring 33 projecting radially beyond the cylindrical jacket 34. The diameter of the cylindrical jacket 34 between the profiled rings 32, 33 is essentially constant. The outer diameter of all the profiled rings 32, 33 is approximately identical. The sleeve 31 can be an extruded plastic part and, in the embodiment shown, is harder than the cylindrical jacket 34, which by contrast is made of relatively soft material, particularly rubber or plastic. The size of the applicator roll is calculated for the profiled rings 33 of the cylindrical jacket to come into contact with the unprinted edges of the label 16', to roll over the edges and to press the label onto the article needing to be marked. The cylindrical jacket 34 between the profiled rings 32, 33 which would pick up the ink does not come into contact with the ink, so there is no fear of the printed data on the label 16' being smeared. The profiled ring 32, which makes contact with and rolls over the center of the label 16', is made of relatively hard material that does not pick up any ink. Hence there can be no smearing of the printed data in this area either. Since the material of the cylindrical jacket 34 is relatively soft, the profiled ring 32 of the sleeve 31 and the profiled ring 33 of the cylindrical jacket 34, which is closer to the labeled article, are still guaranteed to press on the label, even if the labeling apparatus is not placed at exact right angles on the article needing to be marked, because the profiled ring 33 yields accordingly due to its softness.

The result is perfect labeling, without any smearing of the printed data, at a low level of outlay.

What is claimed is:

1. A labeling apparatus for paying out and applying self-adhesive labels, comprising:

a housing which defines a label outlet;

a hub; and an applicator roll mounted by said hub to said housing adjacent to said label outlet, said applicator roll having a sleeve which rotatably mounts said applicator roll to said hub, and a cylindrical jacket about said sleeve, said sleeve being equipped with at least one profiled ring which projects radially outwardly beyond said cylindrical jacket, wherein the material of said sleeve and said at least one profiled ring is harder than said cylindrical jacket and wherein with each operating cycle of the labeling apparatus one self-adhesive label is moved into a dispensing position underneath said applicator roll.

2. The labeling apparatus as defined in claim 1, wherein said at least one profiled ring is integrally formed with said sleeve.

3. The labeling apparatus as defined in claim 1, wherein said sleeve and said at least one profiled ring are made of plastic.

4. The labeling apparatus as defined in claim 1, wherein said at least one profiled ring is arranged according to one of at approximately the center of said sleeve; and shifted away from the center of said sleeve in the longitudinal direction of said sleeve.

5. The labeling apparatus as defined in claim 1, wherein said at least one profiled ring is made of an ink-repellent material.

6. The labeling apparatus as defined in claim 1, wherein said cylindrical jacket is equipped with profiled rings projecting radially outwardly.

7. The labeling apparatus as defined in claim 6, wherein said profiled rings of said cylindrical jacket are located at the longitudinal ends of said cylindrical jacket.

8. The labeling apparatus as defined in claim 6, wherein said profiled rings of said cylindrical jacket are arranged so as to come into contact with the unprinted edges of the self-adhesive label.

9. The labeling apparatus as defined in claim 1, wherein said cylindrical jacket is made of a relatively soft material.

10. The labeling apparatus as defined in claim 9, wherein said soft material is rubber.

11. The labeling apparatus as defined in claim 9, wherein said soft material is plastic.

* * * * *